US005616066A

United States Patent [19]

Jacobs et al.

[11] Patent Number: 5,616,066

[45] Date of Patent: Apr. 1, 1997

[54] MAGNETORHEOLOGICAL FINISHING OF EDGES OF OPTICAL ELEMENTS

[75] Inventors: Stephen D. Jacobs, Pittsford, N.Y.; Igor V. Prokhorov, Minsk, Belarus

[73] Assignee: The University of Rochester, Rochester, N.Y.

[21] Appl. No.: 603,528

[22] Filed: Feb. 21, 1996

Related U.S. Application Data

[63] Continuation-in-part of Ser. No. 543,426, Oct. 16, 1995.

[51] Int. Cl.[6] ..... B24B 1/00

[52] U.S. Cl. ..... 451/36; 451/113; 451/43

[58] Field of Search ..... 451/36, 37, 43, 451/296, 446, 113, 106, 74

[56] References Cited

U.S. PATENT DOCUMENTS

| | | | |
|---|---|---|---|
| 2,735,232 | 2/1956 | Simjian | 451/36 |
| 4,175,930 | 11/1979 | Sakulevich et al. | 451/36 |
| 4,186,528 | 2/1980 | Yascheritsyn et al. | 451/113 |
| 4,821,466 | 4/1989 | Kato et al. | 451/36 |
| 5,449,313 | 9/1995 | Kordonsky et al. | 451/36 |

FOREIGN PATENT DOCUMENTS

| | | | |
|---|---|---|---|
| 1526-957-A | 12/1989 | U.S.S.R. | 451/113 |

OTHER PUBLICATIONS

Magnetorheological finishing: a deterministic process for optics manufacturing; S.J. Jacobs, et al; Proc. Int'l. Conf. on Optical Fabrication and Testing, Aug. 1995 (Conference date Jun. 5–7, 1995, Tokyo, Japan).

*Primary Examiner*—James G. Smith
*Assistant Examiner*—Dona C. Edwards
*Attorney, Agent, or Firm*—M. LuKacher

[57] ABSTRACT

Method and apparatus using magnetorheological fluid for finishing a non-image-forming edge of an optical element to a very high degree of smoothness and for removing microscopic fissures from such edges, the method comprising positioning an optical element near a continuous carrier surface such that a converging gap is defined between an edge of the optical element and the carrier surface, the element being disposed such that image-forming refractive and reflective surfaces thereof do not create a gap with the carrier surface; applying a magnetic field substantially at the gap; introducing a magnetorheological fluid onto the carrier surface; driving the magnetorheological fluid through the gap to cause a flow of magnetic field-stiffened magnetorheological fluid through this gap to create a work zone and to form a transient finishing tool for removing material from the edge of the optical element; and moving the optical element relative to the work zone to expose different portions of the edge to the fluid for predetermined time periods to finish the edge to a predetermined degree. The lateral extent of fluid may be broad enough to permit polishing of a plurality of optical elements simultaneously on a single carrier surface, or a plurality of finishing stations may be ganged to finish a plurality of optical elements on a plurality of carrier surfaces.

31 Claims, 6 Drawing Sheets

MAGNETORHEOLOGICAL FINISHING OF EDGES OF OPTICAL ELEMENTS

This is a continuation-in-part of a pending application Ser. No. 08/543,426 filed Oct. 16, 1995 by Stephen D. Jacobs et al.

The present invention relates to method and apparatus for polishing of glass, plastic, or ceramic surfaces, and particularly for polishing the edges of ophthalmic or optical elements such as lenses and mirrors to a very high degree of smoothness.

Optical elements, for example, ophthalmic and other spherical and aspherical lenses, cylindrical lenses, and both plano and curved mirrors, typically are provided with a relatively rough-cut edge surface which may be beveled, chamfered, or otherwise shaped at one or more angles to the image-forming refractive or reflective surfaces. In some applications, little attention has been paid to smoothing or finishing the edges of such elements since optical performance is generally independent of the quality of finish of the edges.

One problem arising from inadequate smoothing of the edges of optical elements is that the mechanical strength of an element can be compromised by the presence of minute cracks created in the edges during grinding and shaping of the workpiece. For example, commercially-available glass sunglass lenses about 2.5 mm in thickness having ground edges finished by conventional polishing to a roughness of about 20 μm p-v (peak-to-valley) are known to fail by growth of microscopic fractures originating in the edge bevels. Clear lenses about 1.5 mm thick having an edge roughness of about 9 μm p-v can experience the same problem. Polishing these lenses to a p-v roughness of about 0.1 μm or less, and removing grinding-induced fissures, effectively eliminates this source of mechanical failures, but such polishing by conventional techniques can be prohibitively expensive.

Another problem is that rough-cut barrels or edges of large precision optical elements such as laser and astronomical mirrors must be smoothed to a high degree to permit application of special thin-film coatings. Ground edges can entrap polishing agents during the optical grinding and polishing operations, which agents can migrate to the image-forming or reflective surface prior to the application of coatings. Conventionally polishing such edges to provide a clean, residue-free surface can be very costly.

In principle, the edge of an optical element may be polished either before or after polishing of the optical surfaces. However, polishing the edge first is usually not possible because the optic axis of the element must be determined from its finished surfaces, and then the barrel is cut to the optic axis. Generally, edges are polished after the optical surfaces have been finished.

In known edge polishing techniques, a hazard exists in that image-forming optical surfaces near the edge may be inadvertently and easily scratched or abraded during edge polishing. Protective lacquers, if applied to the optical element prior to edge polishing, are known to leave residues that can lower the laser damage resistance of the finished optic (see J. Bennett et al., *Applied Optics*, 28, 1018 (1989)).

Non-planar edges having complex contours are very difficult to polish uniformly and can require a resilient polishing surface, such as a thin polyurethane foam layer over a metal backing plate, which can overlap and damage the image-forming lens surface. Further, the foam layer can wear through very quickly when pressing on a thin glass edge, thereby exposing the edge to damage from contact with the metal plate. Extreme care is required to protect the edge from being damaged. Further, in conventional polishing of V-type edges, the optical element must make two passes over the polisher at very different angles, which is time-consuming and therefore inefficient.

It is known to use fluids containing magnetic particles in polishing applications. U.S. Pat. No. 4,821,466 to Kato et al. discloses a polishing process in which a "floating pad" immersed in a fluid containing colloidal magnetic particles is pushed against a workpiece by buoyancy forces caused by the application of a non-uniform magnetic field. However, the presence of the pad makes it difficult to polish complicated shapes. This polishing process has a rudimentary capability for figure correction which is similar to that used with full aperture, viscoelastic finishing tools. The shape of the float and the shape of the magnetic field must be custom tailored to achieve a specific desired surface shape. To finish another shape with the same process requires different lapping motions, as well as the design and fabrication of a different float and possibly a different magnet configuration. Substantial process and machine modifications are therefore required in order to change optic shapes.

It is also known to polish a workpiece by immersing it in a fluid containing magnetic particles and applying a rotating magnetic field to the fluid. See, e.g., U.S. Pat. No. 2,735,232 to Simjian. The rotating field causes the fluid to flow circularly around the workpiece, thereby polishing it. This method suffers from the disadvantage that it does not create sufficiently high pressure on the workpiece and therefore does not achieve a satisfactory material removal rate.

It is also known to polish a workpiece by exposing it to magnetorheological fluid stiffened by the presence of a magnetic field. U.S. Pat. No. 5,449,313, issued Sep. 12, 1995 to Kordonsky et al., discloses apparatus and methods for magnetorheological polishing of optical surfaces but does not address the special needs of polishing the edges of optical elements.

Thus there exists a need for an effective, inexpensive method and apparatus for finishing the edges of optical elements to a roughness of 0.1 μm or less and for removing or smoothing microscopic fissures in such edges.

It is a principal object of the invention to provide improved method and apparatus for finishing the non-image-forming areas of an optical element to a surface roughness of less than 0.1 μm p-v.

It is a further object of the invention to provide improved method and apparatus for removing or smoothing microscopic fissures in the non-image-forming areas of an optical element to prevent propagation of such fissures and resultant cracking of the element.

It is a still further object of the invention to provide improved method and apparatus for easily polishing the edge of an optical element without risk to its image-forming surfaces.

It is a still further object of the invention to provide improved method and apparatus for easily polishing complex shapes or profiles in the edge of an optical element.

It is a still further object of the invention to provide improved method and apparatus for polishing the edges of a plurality of optical elements simultaneously.

Briefly described, an improved method embodying the invention comprises impinging a flow of a magnetic field-stiffened magnetorheological (MR) fluid through the gap between an optical element edge to be polished and a carrier surface. As disclosed in co-pending parent U.S. application Ser. No. 08/543,426, which is hereby incorporated by reference, the optical elements may be polished to a very high degree by magnetorheological finishing (MRF). A carrier surface, which may be the outer surface of a wheel, the upper surface of a horizontally disposed disc, the inner surface of a doughnut-shaped trough, or the outer surface of a continuous belt, is adapted to receive and carry magnetorheological fluid. MR fluid is preferably an aqueous suspension of non-magnetic abrasive particles and magnetic particles which has a relatively low apparent viscosity in the absence of a magnetic field, but which "stiffens" in the presence of a magnetic field. The workpiece is positioned near the carrier surface such that a converging gap is defined between the workpiece and the carrier surface. Relative motion between the carrier surface and the workpiece, such as rotation of the wheel, disc, or trough, or driving of the continuous belt, serves to drive magnetic field-stiffened MR fluid through the gap. A magnetic field is imposed substantially at the gap to stiffen the MR fluid flowing there and create a work zone. By moving the part through the work zone, material is selectively removed to eliminate subsurface damage, to smooth the surface, and to eliminate scratches such that the p-v value of the surface is gradually reduced. Removal rates of more than 1 μm per minute are easily achieved.

We have found that this technology can be adapted to provide an improved method and apparatus for finishing the non-image-forming edges of optical elements to a very high degree of smoothness to obviate the problems discussed above as engendered by conventional edge polishing techniques. The optical element to be edge-polished is mounted, for example, in a conventional lens chuck with the element edge to be polished near the carrier surface, thereby forming a converging gap. The image-forming surfaces of the element are not suitably oriented to form a converging gap with the carrier surface. Only the element edge experiences substantial abrasive action and therefore material removal. The MR fluid moving relative to the portions of the image-forming surfaces does not substantially abrade those surfaces because there are no conditions suitable for forming a work zone (no converging gap). For wide edges, the optical element may be translated in various predetermined directions relative to the work zone to accomplish the polishing process. For edges which are closed figures, such as the edges of ophthalmic lenses, the element may be rotated and/or translated about its optic axis to progressively expose the entire periphery of the lens to the work zone. When other process parameters are fixed, the amount of material removed can be varied by varying the length of time an edge portion is exposed to the work zone. The degree of finish obtainable can be easily determined without undue experimentation. With an appropriately shaped MR fluid and magnetic field distribution, a plurality of elements may be edge-polished simultaneously on a single apparatus, since each element edge automatically forms its own converging gap and work zone.

Apparatus in accordance with the invention also may be ganged in multiple finishing stations which can finish a plurality of elements simultaneously. Advantageously, a single MR fluid supply system can be configured to provide MR fluid to all such ganged stations.

The foregoing and other objects, features, and advantages of the invention, as well as presently preferred embodiments thereof, will become more apparent from a reading of the following description in connection with the accompanying drawings in which.

Figure 1:
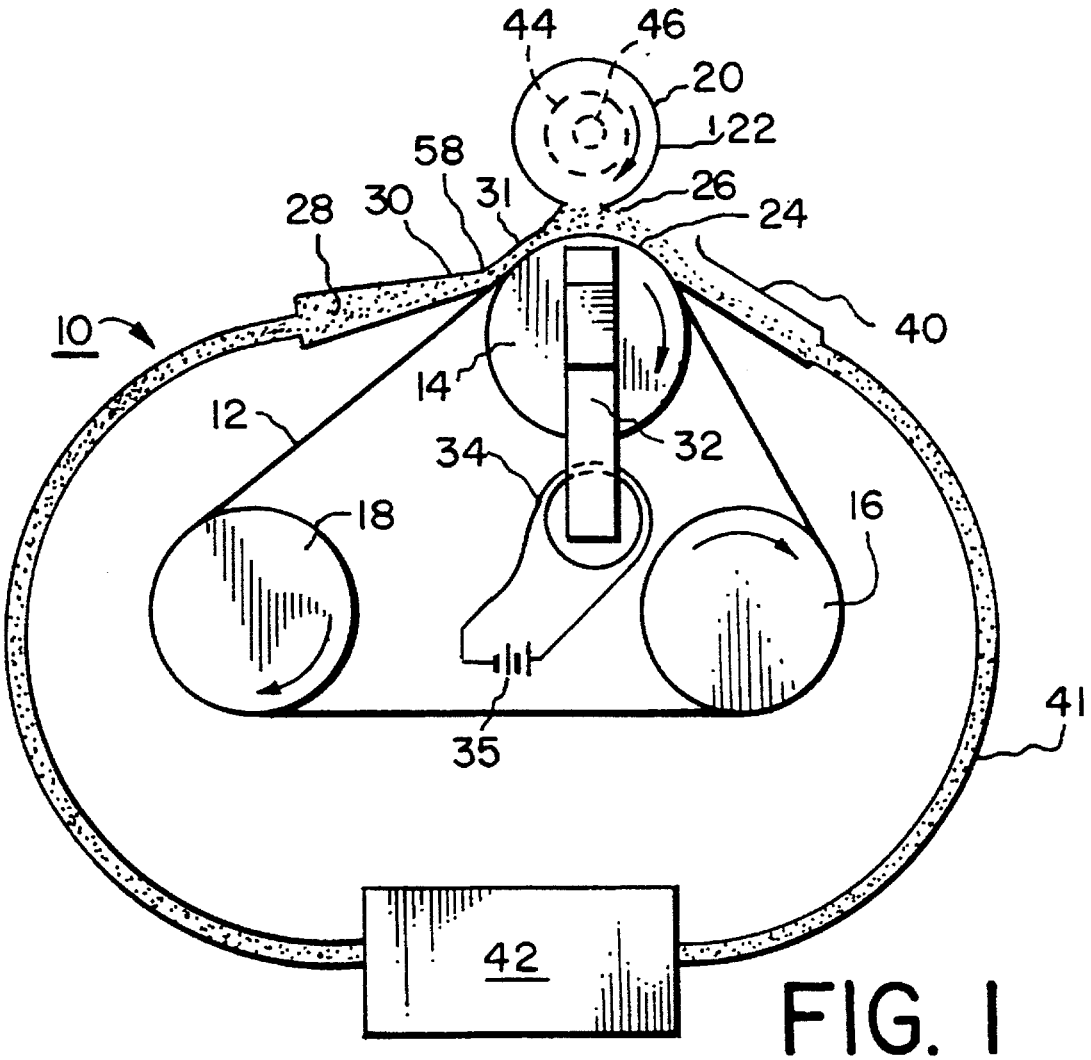
FIG. 1 is a schematic side elevational view of an apparatus in accordance with the invention, showing the edge of an optical element (a lens) being finished.
Figure 2:
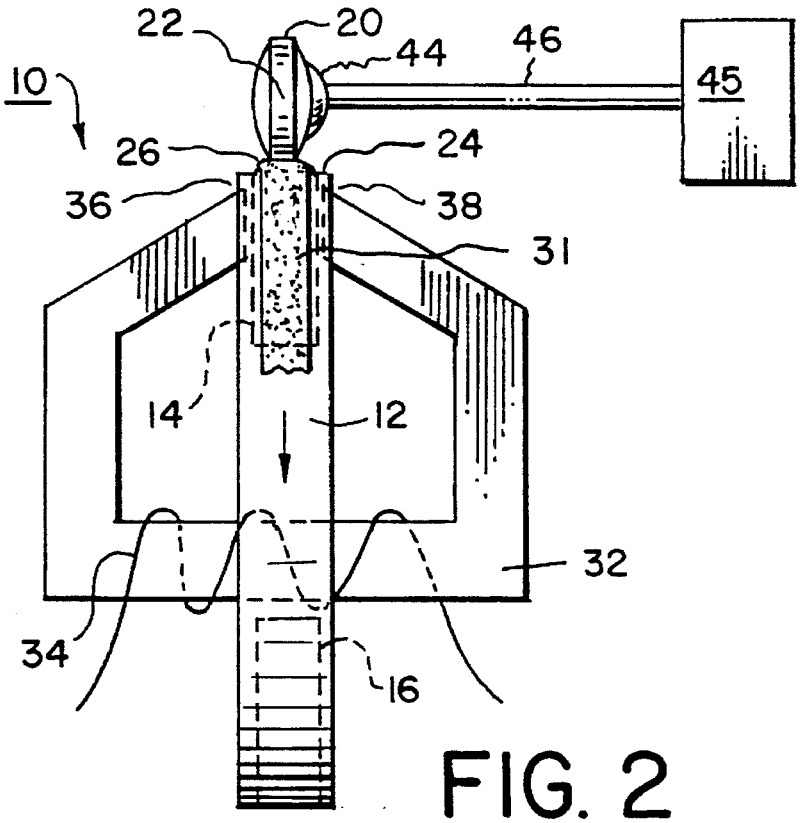
FIG. 2 is a simplified front elevational view of a portion of the apparatus of FIG. 1.

Referring to FIGS. 1 and 2, an assembly 10 includes a continuous belt 12 conveyed on rollers 14, 16, and 18, one or more of which may be driven by conventional means (not shown) to cause belt 12 to be driven longitudinally. Other conveyance components well known in the art of conveying webs, for example, tensioning, steering, motivating, and controlling devices, may also be included in an assembly in accordance with the invention. Belt 12 preferably is formed from stainless steel or other flexible non-magnetic material. An optical element 20 having a fine ground edge 22 requiring finishing is disposed substantially vertically near the outer surface 24 of belt 12 defining thereby a converging gap 26 between surface 24 and edge 22. Element 20 may be formed from, for example, non-metals such as glass, plastic, ceramic, and glass-ceramic; semiconductors such as silicon; or non-magnetic metals such as aluminum and copper. A magnetorheological (MR) fluid 28 is dispensed from nozzle 30 as a band or ribbon 31 onto carrier surface 24 and is carried by belt 12 into gap 26. The MR fluid is dispensed at a controlled flow rate commensurate with the controlled linear speed of belt 12 to provide a ribbon of MR fluid of desired thickness thereon. Electromagnet 32 having windings 34 connected to a DC power source 35 is disposed transversely of said belt with pole pieces 36 and 38 adjacent to gap 26 to create a magnetic field in gap 26. Preferably, the pole pieces extend inwardly under the edge of belt 12 decrease the size of the gap between the pole pieces and thereby intensify and maximize the fringing magnetic field in converging gap 26, and to physically shield the pole piece tips from accumulating residual MR fluid. MR fluid which has been carried through gap 26 is collected from the belt by scoop 40 which directs the MR fluid via conduit 41 to recirculation system 42 where it may be variously treated to regenerate it and return it as by pumping to nozzle 30. Recirculation system 42 and MR fluid 28 may be substantially as disclosed in parent U.S. patent application Ser. No. 08/543,426. Although continuous belt 12 is the preferred carrier for the MR fluid, in accordance with the invention carrier surface 24 may also be the periphery of a vertically mounted wheel, the upper surface of a horizontally mounted disc, or the inner surface of a rotating trough. The MR fluid may be driven into the gap by moving the carrier surface relative to the optical element, as in the embodiment in FIGS. 1 and 2, or by moving the optical element over the work surface.

When the field-stiffened MR fluid 28 flows through gap 26, it creates a work zone that constitutes a transient finishing tool for causing removal of material from the edge 22 of the optical element 20, resulting in a smoothed and polished surface of edge 22. Material is removed from that portion of the edge, so that microscopic fissures in the surface, resulting from fracturing during grinding of the edge, are also eliminated.

The optical element 20 may be positioned and held for edge polishing by conventional means known in the art. For example, element 20 is held by a cup 44 attached to the refractive or reflective surface of element 20 as by suction or adhesive. Cup 20 is attached to shaft 46 which may be the output shaft of any well-known means 45 for controllably rotating and/or translating element 20 during the polishing process, for example, a mechanical cam-follower or a computer numerically controlled (CNC) machine driven by an algorithm for machine control. For relatively thin, round optics such as element 20, a simple rotation of shaft 46, preferably in direction counter to the motion of MR fluid past the element, can suffice. For larger or more complex element edges, particularly planar edges, for example the ends of cylindrical lenses or prisms, both translation and rotation may be necessary. Control of the polishing apparatus and movement of the optical element may be exerted by control means 45 over a predetermined time interval to achieve a predetermined degree of finish of the edge.

Figure 3:
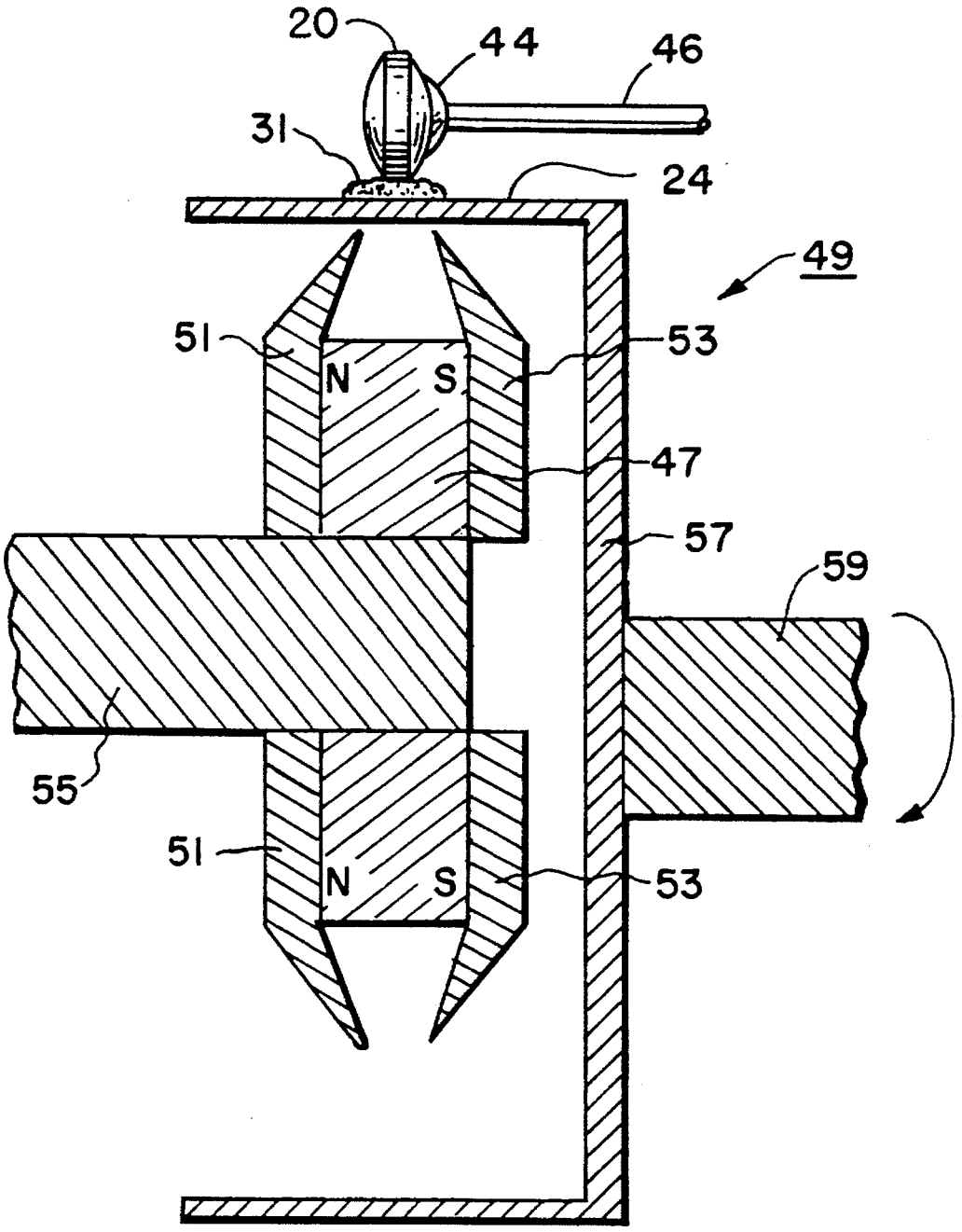
FIG. 3 is a view like that of FIG. 2 showing another embodiment of a magnet.

Alternatively, the magnet providing the field in gap 26 may be a permanent magnet. For example, in a finishing assembly 49 shown in cross-sectional view in FIG. 3, ring magnet 47 having north and south soft iron ring pole pieces 51 and 53, respectively, is fixedly disposed on non-magnetic mount 55 within a non-magnetic carrier drum 57. Drum 57 is adapted to be driven in rotation about shaft 59 and provides a carrier surface 24 on its outer surface.

Figure 4:
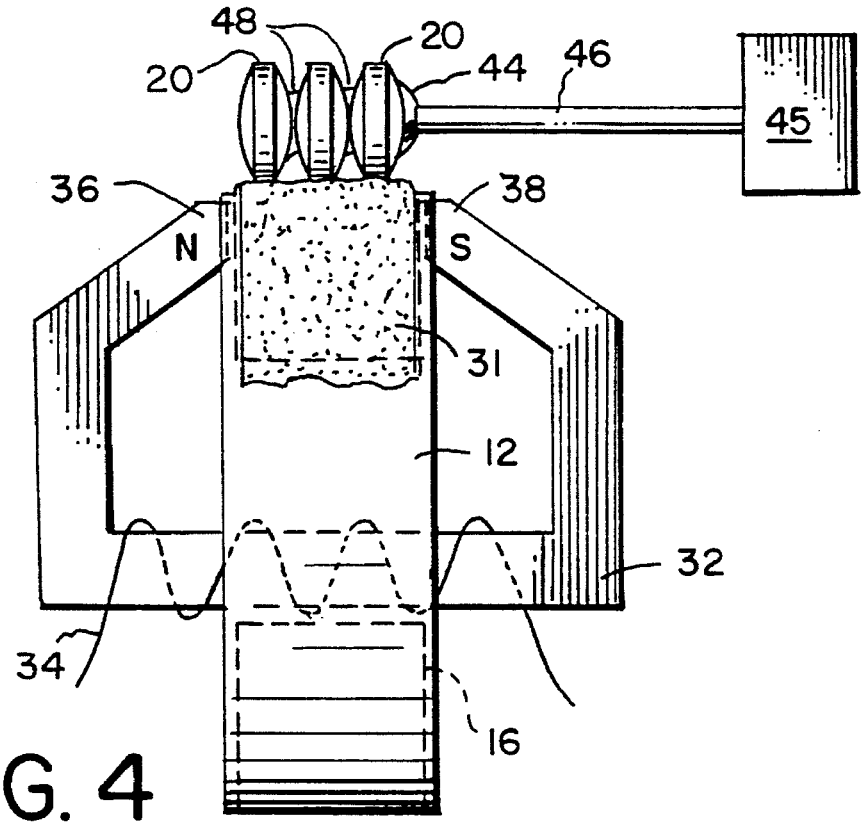
FIG. 4 is a view like that of FIG. 2 showing an apparatus adapted to finish a plurality of commonly-mounted optical elements.

Apparatus in accordance with the invention is adaptable to finish the edges of a plurality of ganged optical elements, as shown in FIG. 4. A widened belt 12 carries a widened MR fluid ribbon 31 for finishing three elements 20 simultaneously. The elements are connected by adapters 48 to be driven identically by shaft 46.

Figure 5:
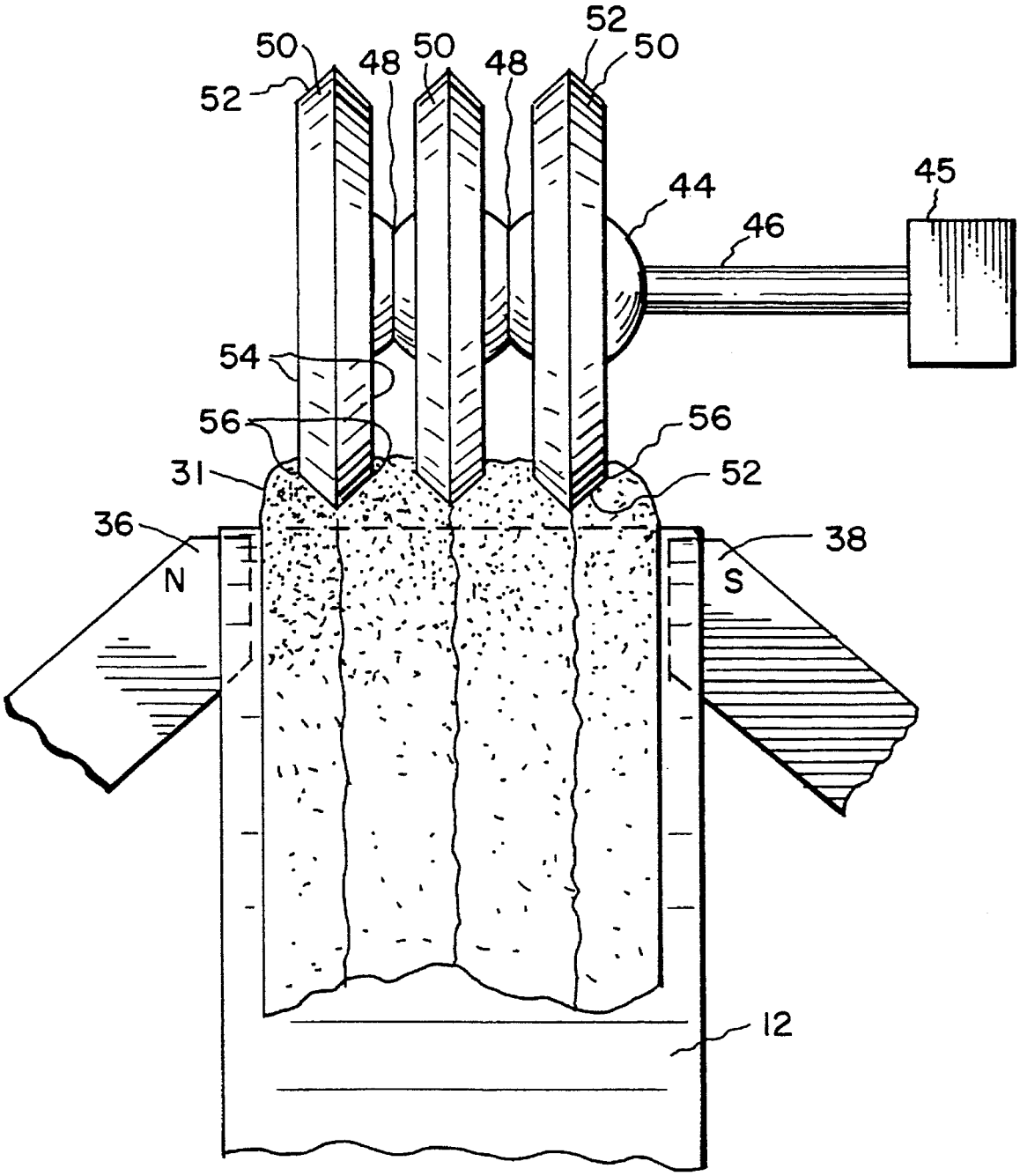
FIG. 5 is a view like that of FIG. 4 showing another apparatus adapted to finish a plurality of commonly-mounted optical elements.

The elements 20 shown in FIGS. 1 through 4 are doubly-convex lenses having cylindrical or barrel edges substantially parallel to their optic axes. Other types of optical elements, for example, ophthalmic lenses, parabolic mirrors, and sunglass lenses, having more complex edges are also readily polished in accordance with the invention. FIG. 5 shows three planar elements 50, for example, chromatic camera filters, having edges 52 bevelled at obtuse angles to the planar surfaces 54 and being ganged for common motion by adapters 48. Elements 50 are oriented so that surfaces 54 do not form a converging gap with carrier surface 24. MR fluid ribbon 31 is broad enough and thick enough to immerse edges 52. To polish edges 52 fully to their intersections 56 with surfaces 54 requires that intersections 56 be immersed in the MR fluid. An advantage of MR fluid edge polishing over previous polishing techniques is that the polishing fluid may come into contact with the optical surfaces 54 without risk of damage to them. MR fluid polishing occurs on all surfaces in contact with the ribbon except for those surfaces which do not form a converging gap with the carrier surface.

Figure 6:
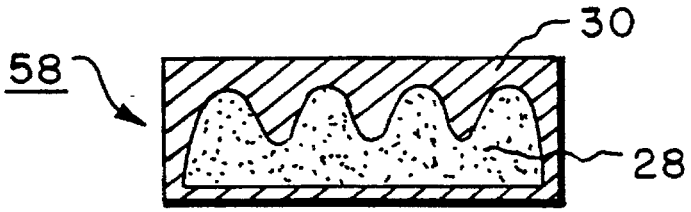
FIG. 6 is a cross-sectional view of a supply nozzle for dispensing magnetorheological fluid onto the carrier surface in accordance with the embodiment shown in FIG. 5.

When polishing multiple compound edges such as those shown in FIG. 5, the ribbon may be pre-shaped on the carrier surface ahead of the work zone to approximate its shape in the work zone. This is readily accomplished by contouring the exit orifice of nozzle 30. For example, an orifice such as orifice 58, shown in FIG. 6, would be useful in providing the contoured ribbon shown in the work zone in FIG. 5. Other shapes are possible for other contoured work zone requirements.

Figure 7:
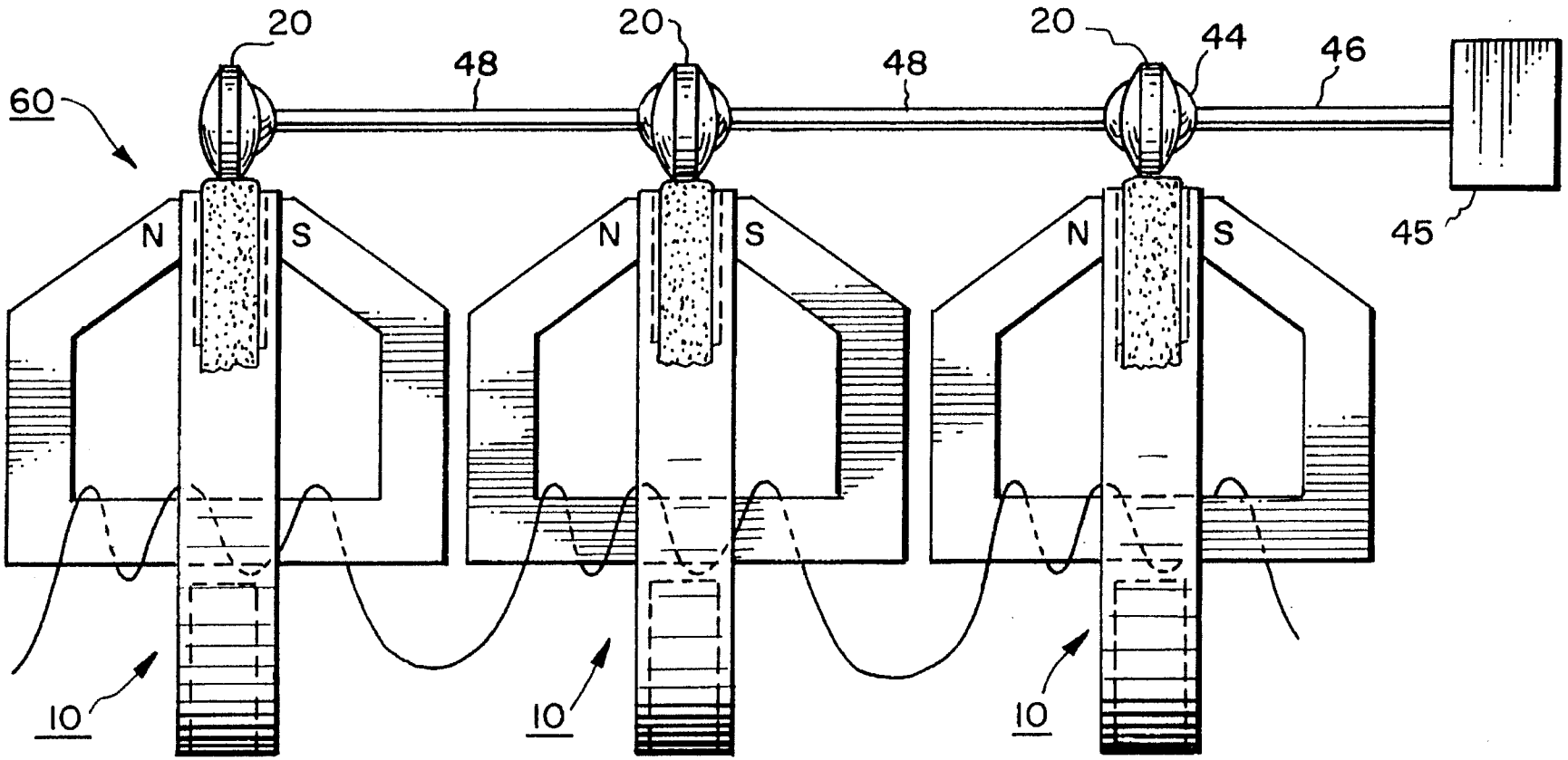
FIG. 7 is a view like that of FIG. 2 showing a plurality of ganged apparati for finishing edges of a plurality of optical elements simultaneously.

A plurality of finishing assemblies 10 in accordance with the invention may be joined to provide a multi-station finishing assembly 60 capable of polishing the edges of a plurality of optical elements 20 identically and simultaneously, as shown in FIG. 7. Advantageously, the multiple stations may be supplied from a single MR fluid recirculation system (not shown) split to provide flows to and from each station. Since MR fluid recirculation and reconditioning is a substantial portion of a polishing installation, this can provide a significant reduction in capital cost. Magnets may be wound individually or in series.

Figure 8:
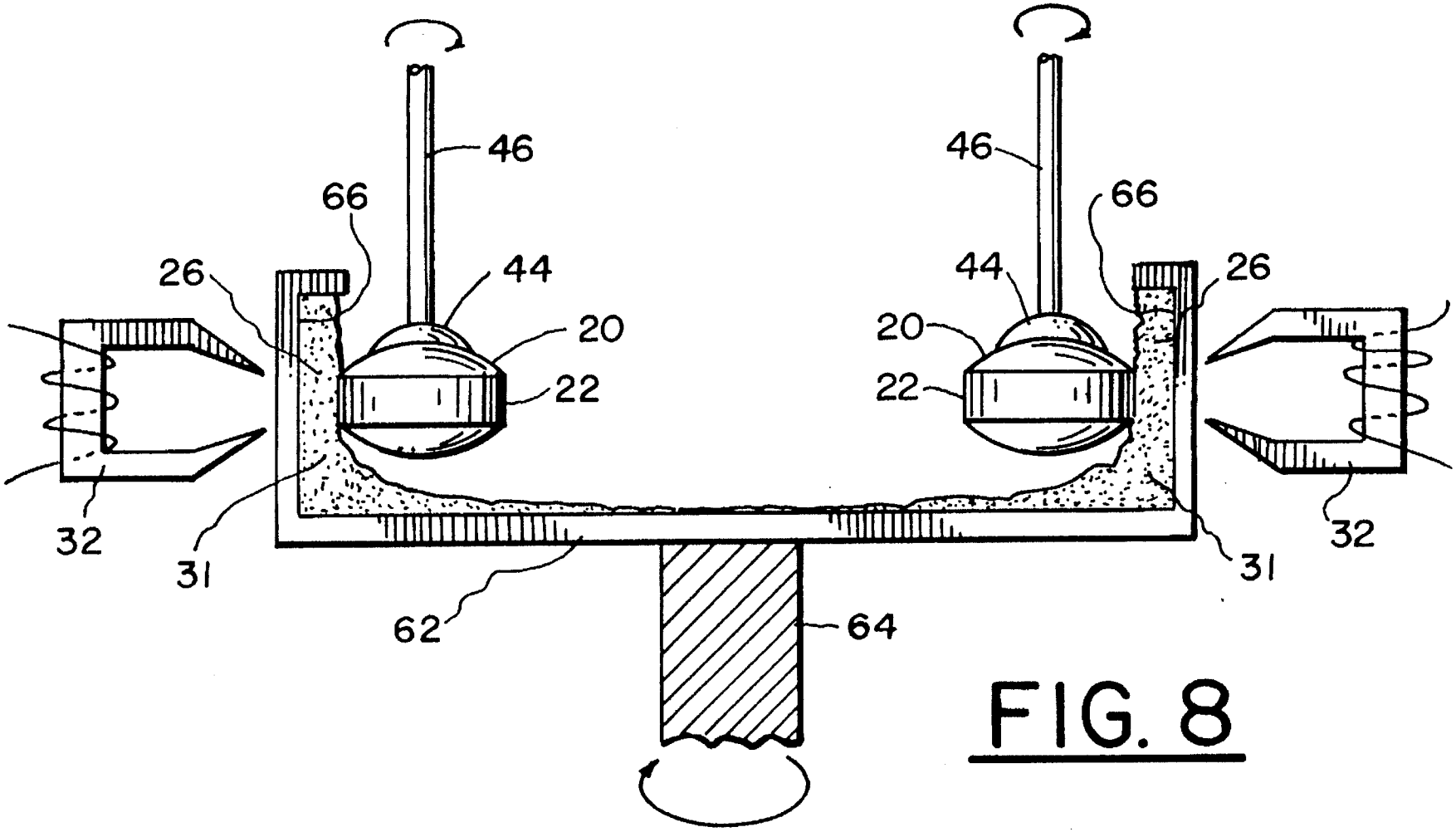
FIG. 8 is a cross-sectional view of another embodiment in accordance with the invention.

MR finishing alternatively may utilized the inner surface of a drum as a carrier surface, as shown in FIG. 8. Drum 62 having a lip 64 is adapted to be rotationally driven about shaft 64. MR fluid 28 within non-magnetic drum 62 is centripetally distributed along, and carried by, the cylindrical wall 66 of the drum. Optical elements 20, mounted for rotation as described for previous embodiments of the invention, are introduced into drum 62 to form converging gaps 26 between element edges 22 and wall 66. A single element may be finished, or a plurality of elements may be finished simultaneously, utilizing a plurality of element mounting shaft work stations 46 entering the drum as required. Electromagnets 32 are radially disposed about the outer periphery of drum 62 and may be a plurality of discrete electromagnets or fixed magnets adjacent to each converging gap within the drum, or the magnet may be a single continuous stationary ring magnet surrounding the drum.

EXAMPLE 1

A commercially-available glass sunglass lens 2.5 mm thick having a surface roughness of the edge of approximately 20 μm p-v is disposed for edge polishing as described above. The lens is slowly rotated about its optic axis. In one hour, roughness is reduced to below 0.1 μm p-v over the edge with no effect on the image-forming surfaces of the lens.

EXAMPLE 2

A laminated glass polarizer lens 1.5 mm thick having a surface roughness of the edge of approximately 9 μm p-v is disposed for edge polishing as described above. The lens is slowly rotated about its optic axis while the edge is immersed in flowing MRF. In less than one hour, roughness is reduced to 0.05 μm p-v.

From the foregoing description it will be apparent that there has been provided improved apparatus and method for polishing the edges of optical elements formed from glass, plastic, or ceramic, wherein very high degrees of surface finish can be achieved rapidly and inexpensively, even for complex edge shapes, with reduced risk of damage to the refractive and reflective surfaces of the elements. Variations and modifications of the herein described apparati and methods in accordance with the invention will undoubtedly suggest themselves to those skilled in this art. Accordingly, the foregoing description should be taken as illustrative and not in a limiting sense.

What is claimed is:

1. A method of finishing an edge of an optical element using magnetorheological fluid, comprising:

a) positioning an optical element near a carrier surface such that a converging gap is defined between an edge of said optical element and said carrier surface, said element being positioned to exclude definition of a converging gap between image-forming refractive and reflective surfaces of said element and said carrier surface;

b) applying a magnetic field substantially at said gap;

c) introducing a magnetorheological fluid onto said carrier surface near said gap, said fluid being stiffened in said magnetic field; and d) providing first relative motion between said carrier surface and said edge to drive said field-stiffened magnetorheological fluid through said converging gap such that a work zone is created by the moving magnetorheological fluid to form a transient finishing tool for engaging and causing material removal at said edge of said optical element.

2. A method in accordance with claim 1 further comprising providing second relative motion between said optical element and said flow of magnetorheological fluid to expose different portions of said edge to said magnetorheological fluid for predetermined time periods to selectively finish said portions of said edge to predetermined degrees.

3. A method in accordance with claim 2 wherein said second relative motion comprises motion of said optical element with respect to said flow of magnetorheological fluid in a direction selected from the group consisting of transverse, concurrent, countercurrent, and rotational.

4. A method in accordance with claim 1 wherein said magnetorheological fluid comprises non-magnetic abrasive particles, non-colloidal magnetic particles, and an aqueous carrier fluid.

5. A method in accordance with claim 4 wherein said non-magnetic abrasive is selected from the group consisting of cerium oxide and nanodiamond particles.

6. A method in accordance with claim 1 further comprising the steps of:

a) collecting said magnetorheological fluid having flowed through said gap; and b) recirculating said collected fluid to reintroduce said fluid to said gap.

7. A method in accordance with claim 1 wherein said step of providing first relative motion comprises moving said carrier surface relative to said optical element to force said fluid to flow through said gap.

8. A method in accordance with claim 7 wherein said carrier surface extends along the periphery of a vertically oriented wheel, and wherein said step of moving said carrier surface comprises rotating said wheel.

9. A method in accordance with claim 7 wherein said carrier surface comprises an upper surface of a horizontally-oriented disc, and wherein said step of moving said carrier surface comprises rotating said disc.

10. A method in accordance with claim 7 wherein said carrier surface comprises an inner surface of a doughnut-shaped trough, and wherein said step of moving said carrier surface comprises rotating said trough.

11. A method in accordance with claim 7 wherein said carrier surface comprises an inner surface of a rotatable drum, and wherein said step of moving said carrier surface comprises rotating said rotatable drum.

12. A method in accordance with claim 7 wherein said carrier surface comprises a continuous belt, and wherein said step of moving said carrier surface comprises driving said belt.

13. A method in accordance with claim 1 further comprising the step of imparting a predetermined shape to the flow of said magnetorheological fluid into said gap to vary the configuration of said work zone.

14. A method in accordance with claim 1 wherein said optical element is selected from the group consisting of ophthalmic lens, sunglasses lens, parabolic mirror, and cylindrical lens.

15. A method in accordance with claim 1 wherein said material is selected from the group consisting of glass, plastic, ceramic, glass-ceramic, semiconductors, and non-magnetic metals.

16. An apparatus for finishing an edge of an optical element using magnetorheological fluid, comprising:

a) a carrier surface adapted to carry a flow of magnetorheological fluid;

b) an optical element holder for holding an optical element to position a portion of an edge of said optical element near said carrier surface to define a converging gap therebetween, and to position said element such as to exclude definition of a converging gap between image-forming refractive and reflective surfaces of said element and said carrier surface;

c) a magnet for applying a magnetic field at said gap;

d) means for introducing magnetorheological fluid to said carrier surface near said converging gap, said fluid becoming stiffened in said magnetic field;

e) means for moving one of said carrier surface and said element holder relative to the other in first relative motion such that said stiffened magnetorheological fluid on said carrier surface is driven through said gap to create a work zone in the magnetorheological fluid forming a transient finishing tool for engaging and causing material removal at said portion of said edge.

17. An apparatus in accordance with claim 16 further comprising means for providing second relative motion between said optical element and said magnetorheological fluid to expose different portions of said edge to said magnetorheological fluid for predetermined time periods to selectively finish said portions of said edge in predetermined degrees.

18. An apparatus in accordance with claim 16 wherein said carrier surface is a surface of a carrier selected from the group consisting of a vertically-oriented wheel, a horizontal disc, a doughnut-shaped trough, a continuous belt, and a drum.

19. An apparatus in accordance with claim 16 further comprising a nozzle for depositing said fluid on said carrier surface, a collector for collecting said magnetorheological fluid having flowed through said gap, and recirculating means for recirculating said collected fluid.

20. An apparatus in accordance with claim 16 wherein said magnet comprises pole pieces configured for maximizing the fringing magnetic field at the work zone.

21. An apparatus in accordance with claim 16 wherein said magnet is a ring magnet.

22. An apparatus in accordance with claim 16 further comprising means for moving said optical element in a plane relative to said carrier surface.

23. An apparatus in accordance with claim 16 further comprising means for rotating said optical element relative to said carrier surface.

24. An apparatus in accordance with claim 16 wherein said optical element holder is adapted to hold a plurality of optical elements.

25. An apparatus in accordance with claim 16 wherein said carrier surface is an inner surface of a surface carrier selected from the group consisting of a doughnut-shaped and a drum.

26. An apparatus in accordance with claim 16 wherein said carrier surface is an outer surface of a surface carrier selected from the group consisting of a vertically-oriented wheel and a continuous belt.

27. An apparatus for finishing edges of a plurality of optical elements simultaneously using magnetorheological fluid, comprising a plurality of finishing stations, each of said stations comprising:

a) a carrier surface adapted to carry a flow of magnetorheological fluid;

b) an optical element holder for holding an optical element to position a portion of an edge of said optical element near said carrier surface to define a converging gap therebetween, and to position said element such as to exclude definition of a converging gap between image-forming refractive and reflective surfaces of said element and said carrier surface;

c) a magnet for applying a magnetic field at said gap;

d) means for introducing magnetorheological fluid to said carrier surface near said converging gap, said fluid becoming stiffened in said magnetic field;

e) means for moving one of said carrier surface and said element holder relative to the other in first relative motion such that said stiffened magnetorheological fluid on said carrier surface is driven through said gap to create a work zone in the magnetorheological fluid forming a transient finishing tool for engaging and causing material removal at said portion of said edge.

28. An apparatus in accordance with claim 27 further comprising a common supply and recirculating system for magnetorheological fluid in communication with each of said finishing stations.

29. An apparatus in accordance with claim 27 further comprising means for providing second relative motion between at least one of said optical elements and said flows of magnetorheological fluid to expose different portions of at least one of said edges to said magnetorheological fluid for predetermined time periods to selectively finish said portions of said edge in predetermined degrees.

30. An apparatus in accordance with claim 27 wherein at least one of said plurality of element holders is adapted to hold a plurality of optical elements.

31. An apparatus for finishing edges of a plurality of optical elements simultaneously using magnetorheological fluid, comprising a plurality of finishing stations, each of said stations comprising:

a) a carrier surface adapted to carry a flow of magnetorheological fluid;

b) an optical element holder for holding an optical element to position a portion of an edge of said optical element near said carrier surface to define a converging gap therebetween, and to position said element such as to exclude definition of a converging gap between image-forming refractive and reflective surfaces of said element and said carrier surface;

c) a magnet for applying a magnetic field at said gap;

d) means for introducing magnetorheological fluid to said carrier surface near said converging gap, said fluid becoming stiffened in said magnetic field;

e) means for moving said carrier surface relative to said element holder such that said stiffened magnetorheological fluid on said carrier surface is driven through said gap to create a work zone in the magnetorheological fluid forming a transient finishing tool for engaging and causing material removal at said portion of said edge;

wherein said means for moving is a rotatable drum and said plurality of carrier surfaces of said plurality of work stations are collectively defined as the inner cylindrical surface of said drum, said plurality of work stations being radially disposed within said drum, the number of said plurality of magnets being equal to the number of said plurality of work stations, and one of said plurality of magnets being disposed outside of said rotatable drum opposite each of said work stations.

* * * * *

UNITED STATES PATENT AND TRADEMARK OFFICE

CERTIFICATE OF CORRECTION

PATENT NO. : 5,616,066

DATED : April 1, 1997

INVENTOR(S) : Stephen D. Jacobs, et. al.

It is certified that error appears in the above-identified patent and that said Letters Patent is hereby corrected as shown below:

On the Title page, change "[73] Assignee: The University of Rochester, Rochester, New York" to --[73] Assignees: University of Rochester, Rochester, New York And Byelocorp Scientific, Inc., New York, New York --.

Signed and Sealed this

Seventh Day of April, 1998

Bruce Lehman

*Attest:*

BRUCE LEHMAN

*Attesting Officer*

*Commissioner of Patents and Trademarks*